United States Patent [19]

Luchi

[11] 4,217,936

[45] Aug. 19, 1980

[54] WEAVING MACHINES OF THE NON-RECIPROCATING CONTINUOUS TYPE

[76] Inventor: Vinicio Luchi, Via Firenze 40H, Prato, Firenze, Italy

[21] Appl. No.: 954,835

[22] Filed: Oct. 26, 1978

Related U.S. Application Data

[63] Continuation of Ser. No. 794,232, May 5, 1977, abandoned.

[30] Foreign Application Priority Data

May 13, 1976 [IT] Italy ..... 9448 A/76

[51] Int. Cl.[2] ..... D03D 47/26

[52] U.S. Cl. ..... 139/436

[58] Field of Search ..... 139/13, 436

[56] References Cited

U.S. PATENT DOCUMENTS

| | | | |
|---|---|---|---|
| 955,211 | 4/1910 | Salisbury | 139/436 |
| 1,161,979 | 11/1915 | Salisbury | 139/436 |
| 3,749,135 | 7/1973 | Linka | 139/436 |
| 3,908,706 | 9/1975 | Onikou et al. | 139/426 |

FOREIGN PATENT DOCUMENTS

| | | | |
|---|---|---|---|
| 1102743 | 5/1955 | France | 139/436 |

*Primary Examiner*—Henry Jaudon

*Attorney, Agent, or Firm*—Haseltine, Lake & Waters

[57] ABSTRACT

A weaving machine of the non-reciprocating continuous type comprises weft carriers which are advanced along the weft direction by impulses imparted by a series of rocking sinkers arranged along the weft direction. The impulses are applied by pivotal movement of successive sinkers in one direction, and during movement of each sinker in the reverse direction the sinker acts to beat-up the deposited weft. Pivotal movement of the sinkers is effected by an endless sinker control track which is driven continuously by an endless chain.

1 Claim, 19 Drawing Figures

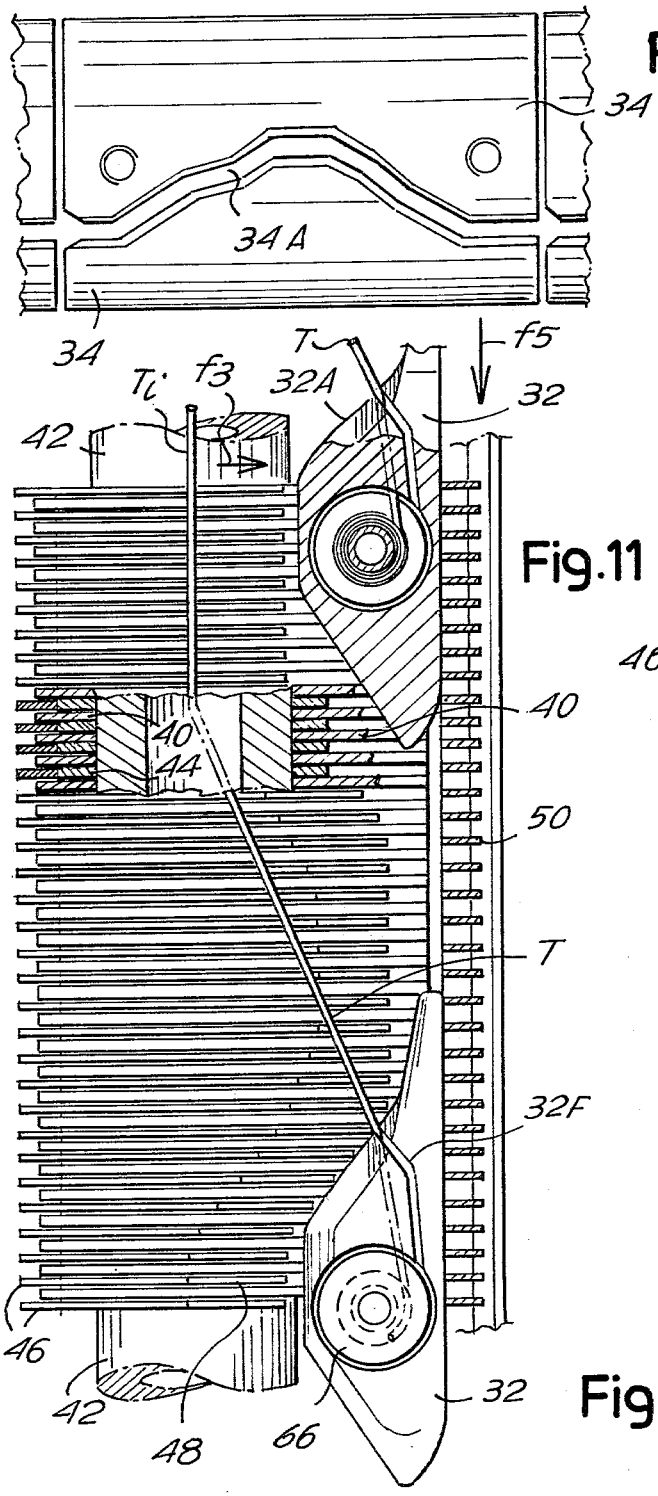
Fig.13
Fig.11
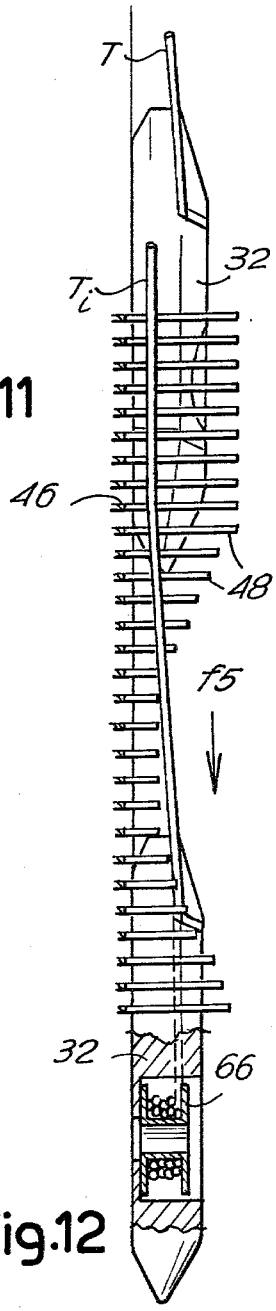
Fig.12

WEAVING MACHINES OF THE NON-RECIPROCATING CONTINUOUS TYPE

This is a continuation of application Ser. No. 794,232 filed May 5, 1977, now abandoned.

FIELD OF THE INVENTION

The present invention relates to weaving machines of the non-reciprocating continuous type.

SUMMARY OF THE INVENTION

According to the present invention, there is provided in a weaving machine of the non-reciprocating continuous type employing, heald loops for controlling the warps, weft-carriers, a series of weft-carrier thrust elements, and means for advancing successive thrust elements to form a thrust wave which advances each weft carrier across the warps, the improvement comprises providing rocking sinkers defining said thrust elements, each said sinker having a control butt, means defining annular seats for the rocking sinkers, means for rocking the sinkers whereby each sinker moves through an advancing stroke to advance the weft carrier and through a return stroke, said means for rocking the sinkers being defined by control track means engaged with the sinker control butts, and endless chain means carrying said control track means, each of said sinkers further comprising means effective at the return stroke of the sinker to beat-up the weft deposited by the weft carrier.

Further according to the present invention, there is provided in a weaving machine, heald loops for controlling the warps, weft-carriers, a series of rocking sinkers spaced along the weft direction, each said sinker having a weft-carrier thrust element and means for engaging the deposited weft, means defining a weft-carrier support surface extending in the weft direction, means for pivoting in one direction successive sinkers along the weft direction such that the thrust elements of successive sinkers engage said weft carrier on the support surface and apply an impulse to the weft carrier to advance the weft carrier along the support surface depositing the weft and means for pivoting the successive sinkers in the opposite direction whereby the weft-engaging means of the successive sinkers engages the deposited weft so as to beat-up the weft, said means for pivoting successive sinkers first in one and then in an opposite direction comprising an endless sinker control track and endless drive means for continuously moving said track.

BRIEF DESCRIPTION OF THE DRAWINGS

An embodiment of the invention will now be described, by way of example only, with reference to the accompanying diagrammatic drawings, in which:

FIG. 11 is a view similar to that of FIG. 9, but partially in section;

FIG. 12 is a view similar to FIG. 10, but partially in section;

FIG. 13 is a fragmentary elevation of cam profiles for operating the weft-carriers or shuttles;

DESCRIPTION OF THE PREFERRED EMBODIMENT

Figure 1:
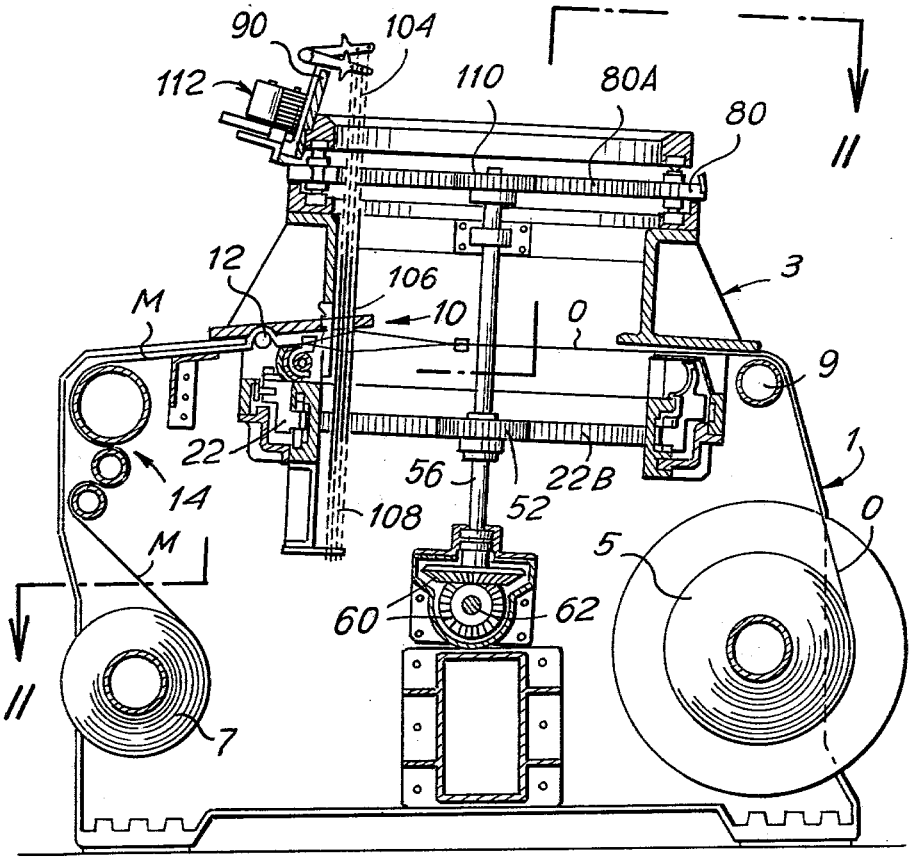
FIG. 1 is a cross-section of a weaving machine in accordance with the present invention.

The weaving machine shown in the accompanying drawings comprises a frame 1 with an overlying structure 3 for the weaving. This structure 3 is formed (see in particular FIG. 2) with two continuous annular tracks each including two parallel rectilinear portions, and arcuate connecting portions substantially of semi-circular form. The tracks are intended to guide chains to be described hereinafter. The numeral 5 denotes a warp beam, while 7 indicates a winding beam for the woven fabric. From the warp beam 5, the warps O are deflected over a bar 9, and reach a selection zone 10 in which the warps O are operated by means of heald loops or healds and then reach the weaving zone. The woven fabric M is engaged by a feed roller 12 and advanced to the beam 7, via a guide and braking unit 14 of a known type.

Figure 8:
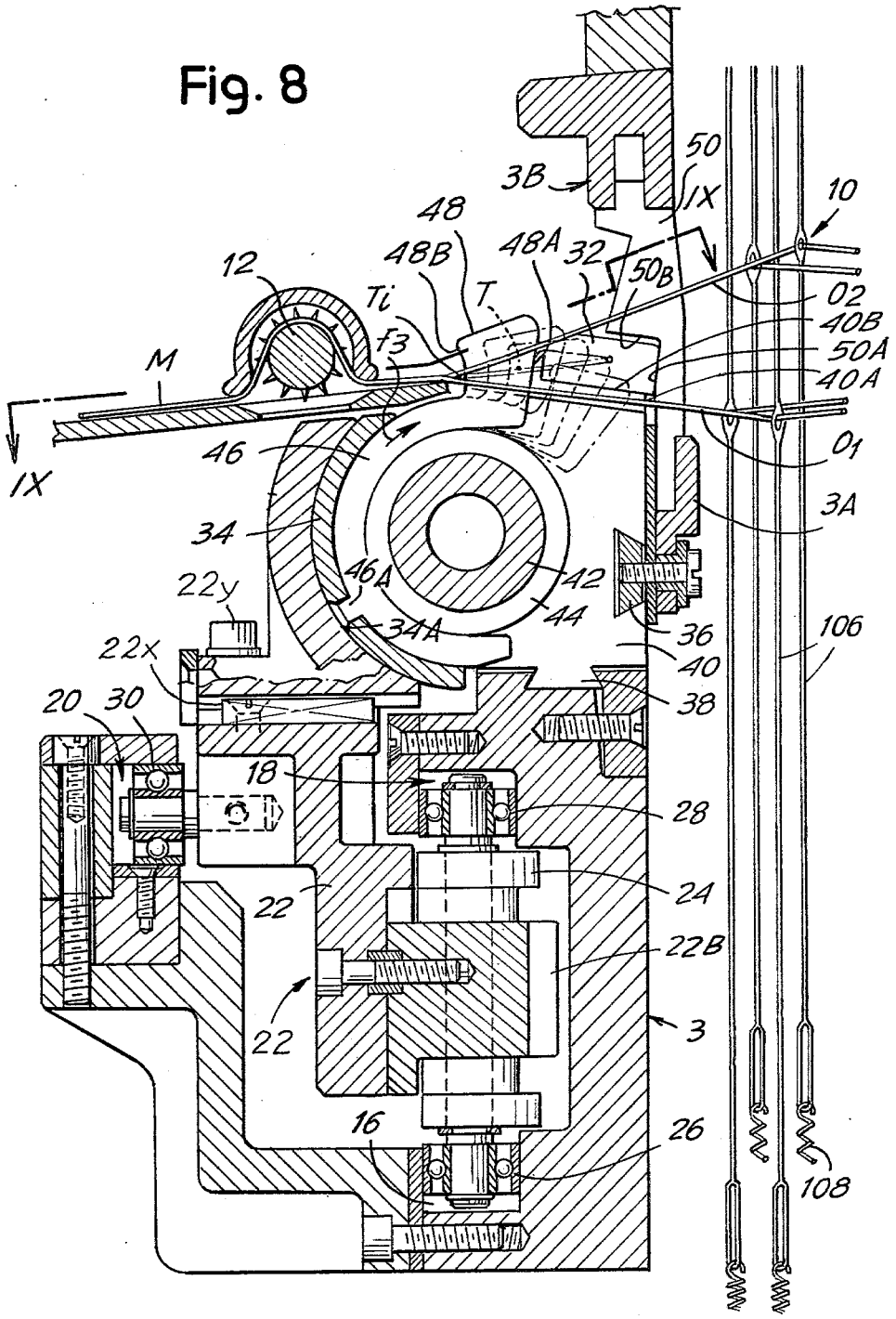
FIG. 8 is an enlarged detail of the portion indicated by arrow VIII of FIG. 3.

The first annular track is formed by channels or tracks 16, 18 and 20 (see FIGS. 2, 3 and 8) having rectilinear portions parallel to the beams 5 and 7 and to the array of heald loops, as well as semi-circular connecting portions. Carriage members 22 of a first chain are guided in the tracks 16, 18 and 20. The chain comprises, in addition to the members 22, pairs of chain links 24 connecting the carriage members 22 to each other. The carriage members 22 each comprise a pair of lower rollers 26 engaged in the track 16, a pair of upper rollers 28 engaged in the track 18, and a pair of lateral rollers 30 engaged in the track 20, the rollers 26 and 28 being coaxial and having a vertical axis and the rollers 30 having a horizontal axis and rest on the lower side of the track 20. Consequently, the carriage members 22 of the chain are firmly guided along the tracks formed therefor in the structure 3.

The chain is arranged to operate, with a non-reciprocating continuous motion, the feed of weft-carriers or shuttles generally denoted by 32. Each of the carriage members 22 has an arcuate body portion 22A (see FIGS. 3 and 8) which is provided with cam portions 34 of substantially semi-cylindrical form, the cam portions have control tracks or channels indicated by 34A (see FIGS. 8 and 13).

Blades 40 are assembled on the structure 3, using dovetail means 36 and 38. The blades 40 each being shaped for dove-tail engagement with the means 36 and 38 and each have an opening receive a cylindrical bar 42 extending parallel to the weaving front and thus parallel to, and above, the tracks 16, 18. The blades 40 further have two upper profiles 40A and 40B which are shaped to allow the former a sufficient space to present the warps $O_1$ instantaneously in the lower position, while the latter serve to define a discontinuous supporting and sliding surface for the shuttles 32.

The cylindrical bar 42 is coaxial with the substantially semi-cylindrical cam portions 34. Rings 44 are mounted on the bar 42 defining the bottom of annular channels, the sides of which are defined by the blades 40; these annular channels serve as sliding seats for arcuate rocking sinkers 46 which are provided with a butt 46A engaged in the channels 34A of the cam portions 34. Further, each of the sinkers 46 has an extension 48 which projects through the warp shed between the adjacent warps to beat-up the just-inserted wefts, such as indicated by Ti in FIG. 8 adjacent the roller 12. The sinkers 46, are designed to rock in the annular channels about the axis of the bar 42, in such a manner as to be moved successively into a plurality of positions such as those indicated in broken lines in FIG. 8, for the hereinafter indicated purposes.

Figure 9:
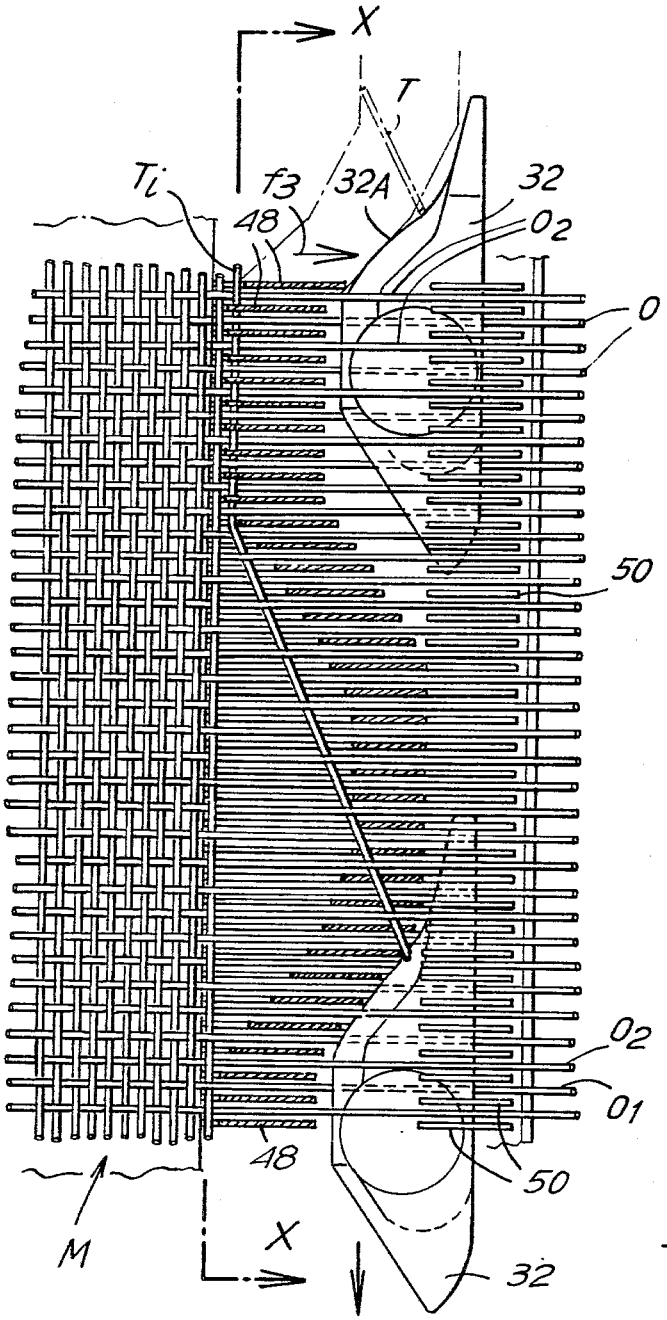
FIG. 9 is a view along line IX—IX of FIG. 8.
Figure 10:
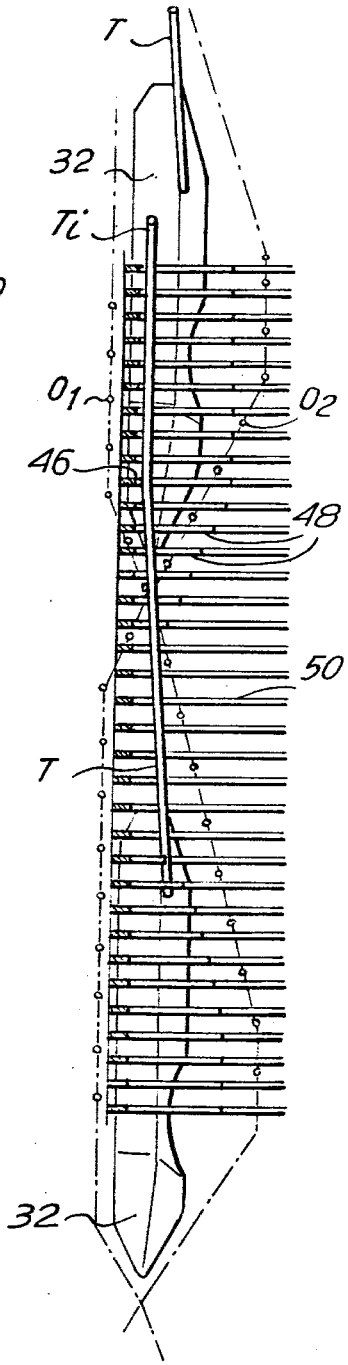
FIG. 10 is a view along line X—X of FIG. 9.

The structure 3 has lower and upper bar-like portions 3A and 3B (see FIG. 8) between which are mounted comb blades 50 which extend through the warp shed. The warps O pass between the comb blades 50 as is shown in FIG. 9 and the comb blades 50 are substantially coplanar with the extensions 48 of the sinkers 46. The comb blades 50 have a stepped profile 50A, 50B, the portions 50A of which form, with the profiles 40A, a lateral support for the shuttles 32 transversely to the sliding surface defined by the profiles 40B. The portions 50B of the stepped profile of the comb blades 50 form a guide for restraining, the shuttles 32 from above against an accidental upward movement out of the warp shed. This takes place in co-operation with the warps $O_2$ which are instantaneously located in the upper position in defining the warp shed.

Figure 2:
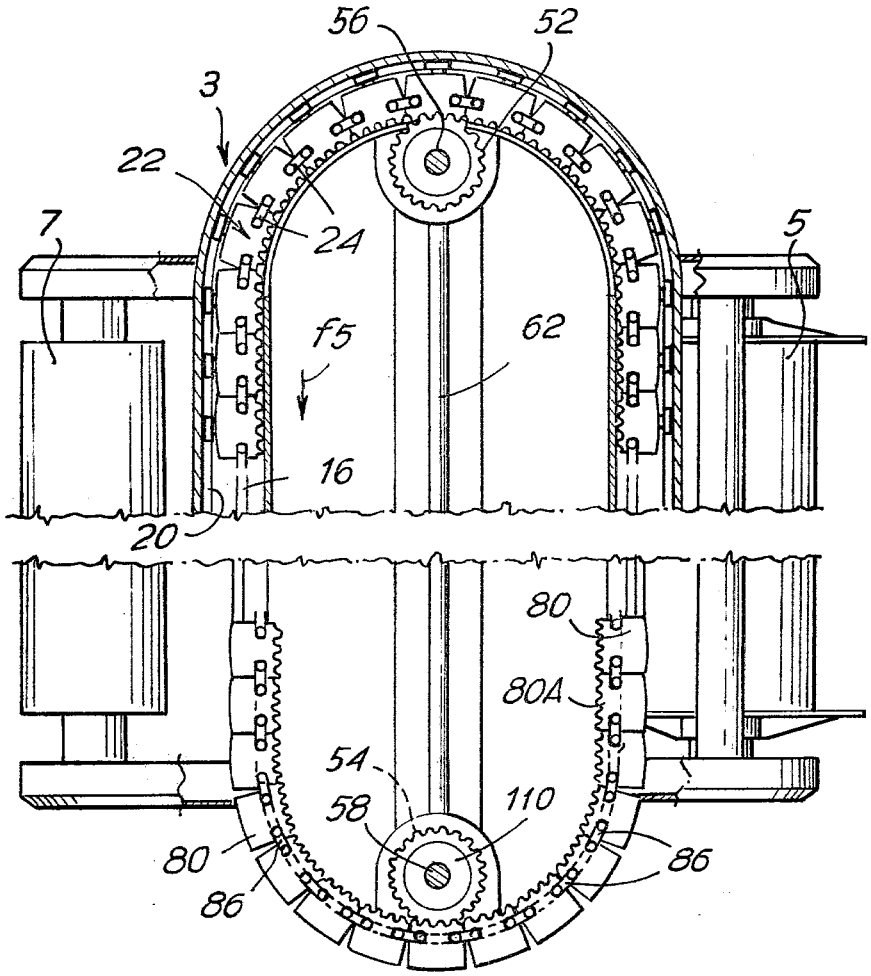
FIG. 2 is a horizontal section taken on line II—II of FIG. 1.
Figure 3:
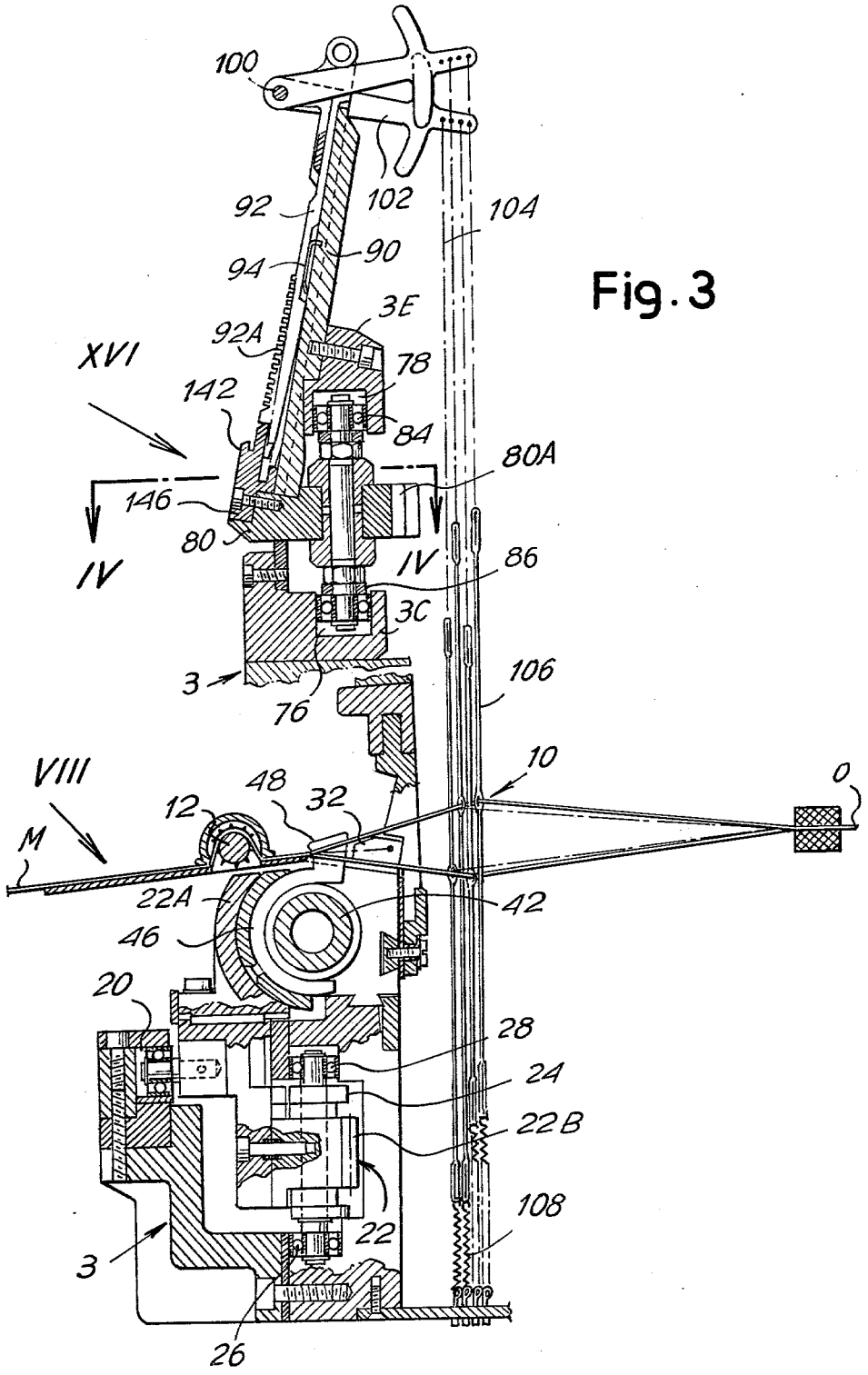
FIG. 3 is an enlarged detail of FIG. 1.

The carriage members 22 each have a toothed profile 22B on the surface thereof which forms the internal surface of the chain 22. As shown in FIG. 2, the toothed profiles 22B of adjacent carriage members along the semi-circular connecting portions of guide tracks of the chain 22 are contiguous and are concentric with the connecting portions of the track to define an arcuate rack which effectively meshes with gears 52, 54 effective to continuously drive the chain. The two gears 52, 54 are mounted on respective shafts 56, 58 and are driven, via mating bevel gears 60, by a drive shaft 62.

The shape of each of the shuttles 32 is clearly shown in FIGS. 9 and 11. In particular, each has an inclined rear profile 32A, on which forward profiles 48A of the sinker extensions 48 act when the latter are moved according to the arrows $f_3$, in a direction which is effective to advance the shuttles 32 according to the arrows fs. This direction being the feed direction of the chain along the active portion for the formation of the fabric (the active portion being the left-hand portion in FIG. 2). The movement of the shuttles 32 is a continuous movement and occurs by advancing successive sinkers 46 so that, by means of their profiles 48A, the sinkers 46; apply a series of impulses to each shuttle 32 which cause the shuttle to move through the warp shed in the direction of the arrow $f_3$, although the shuttle is separate from any other member and is guided along the profiles 40B, 40A, 50B and the upper warps $O_2$. The sinkers 46 are then successively retracted in the reverse direction to that of the arrow $f_3$ in preparation for the subsequent shuttle. In effect, the advance and retraction of the successive sinkers 46 occurs with a wave-like motion (as may be seen in FIG. 9) and each shuttle 32 is advanced by the advancing wave. During its advance each shuttle 32 deposits a respective weft T, which is retained at the beginning of the active stroke of the shuttle outside of the fabric, the weft T is deposited in the warp shed and beating-up of the deposited weft is progressively effected by rear profiles 48B of the sinker extensions 48 when the sinkers 46 are retracted in the opposite direction to the arrow $f_3$. The interlacing action effected by the heald loops after the passage of each shuttle 32 determines the fabric structure.

The shuttles 32 are loaded with lengths of weft T in any suitable manner along the inactive part of the shuttle path.

Figure 14:
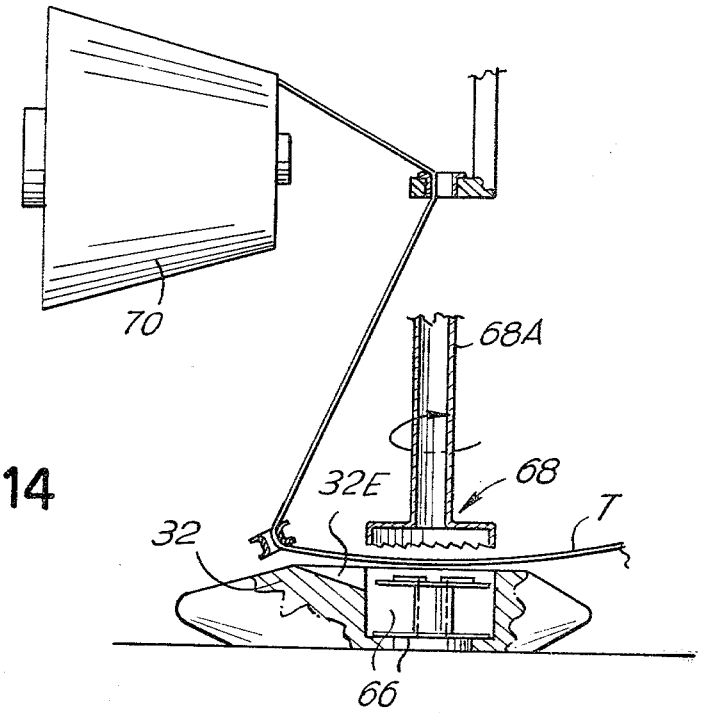
FIGS. 14 and 15 show schematically a system for charging a weft-carrier or shuttle with lengths of weft yarn during two stages of this operation.
Figure 15:
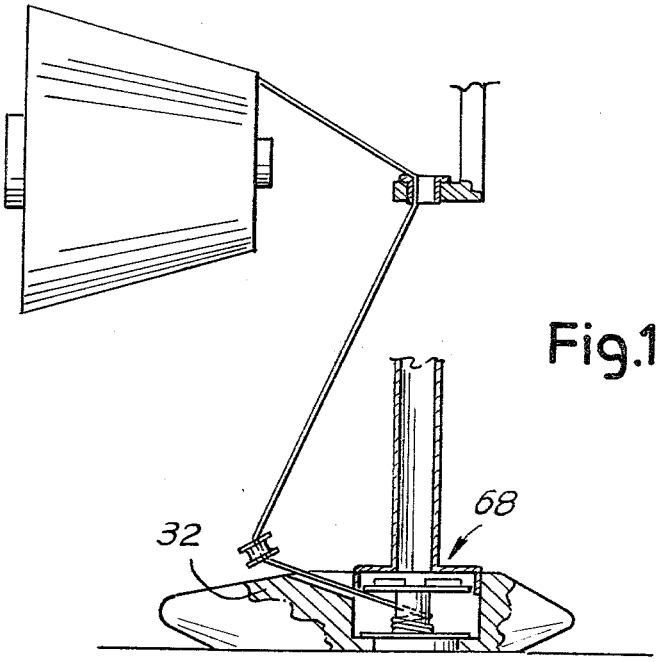

FIGS. 14 and 15 show one possible manner of loading the shuttles 32 with the lengths of weft to be distributed during each cycle along the annular path provided for the shuttles. Each shuttle has a seat 32E for a bobbin 66 which is rotated to wind and unwind the weft. At a position outside of the active portion of its path, the shuttle moves into a position in which its bobbin 66 is coupled to a rotary drive member 68 which, upon being inserted into the seat 32E, engages the bobbin 66 and causes it to rotate, and also hooks the weft T for winding the weft which is fed from a bobbin 70. The bobbin can have a toothed front edge to entrain the end of the weft during the initial winding of the yarn around the bobbin 66. The bobbin 66, which is braked by friction, can be rotated to permit the weft wound thereon, to unwind when the shuttle 32 is advanced along the active portion of its path to deposit the weft in the warp shed. The end of the weft is retained in a manner known per se by a clamp or by a suction device at the beginning of the active portion of the shuttle path, and the weft unwound from the bobbin 66 passes from the shuttle via a channel 32F in the body of the shuttle 32. The weft comes out above the extension 48 towards the end of the stroke of the sinker 46 in the direction of the arrow $f_3$, and the weft is taken by the rear profile 48B during the stroke of the sinker 46 in the opposite direction to that of the arrow $f_3$ to beat-up the weft.

The machine shown incorporates a selection system for the warp for forming Jacquard-type patterns. The selection system operates by selecting individual heald loops from the assembly thereof. The system will now be described in detail with particular reference to FIGS. 16 to 19.

Figure 4:
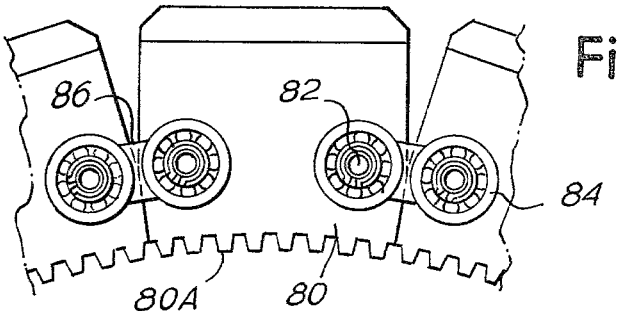
FIG. 4 is a section taken on line IV—IV of FIG. 3 showing part of a chain for operating warp pattern selectors.
Figure 5:
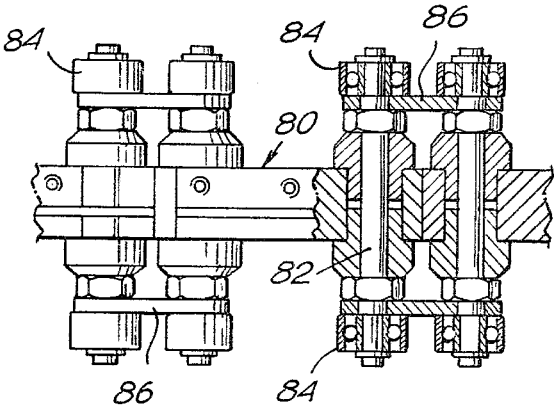
FIG. 5 is a fragmentary front elevation, partially in section, of the chain.
Figure 6:
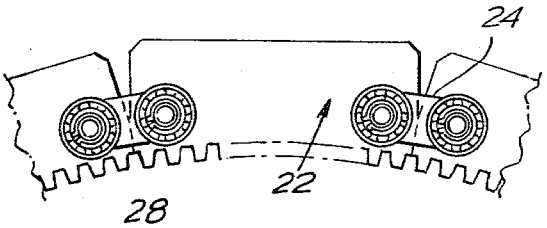
FIGS. 6 and 7 are views similar to FIGS. 4 and 5 of a chain for operating weft-carriers or shuttles.
Figure 7:
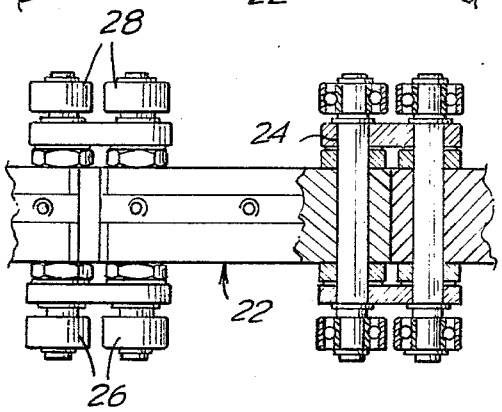

On the structure 3, with the aid of a structural element 3C and of supports, (not shown) for an overlying element 3E, a second endless chain track is formed, the track being constituted by by lower and upper channels 76, 78 formed in the respective elements 3C and 3E. A second chain is formed by blocks 80 (see also FIGS. 4 and 5), each having seats for two small shafts 82 carrying rollers 84 at each end, the shafts 82 being connected by chain links 86. The shafts 82 are vertically directed so that the rollers 84 are engaged in the channels 76, 78, and the weight of the chain assembly is supported on bearing means made of self-lubricating resin or the like.

Figure 16:
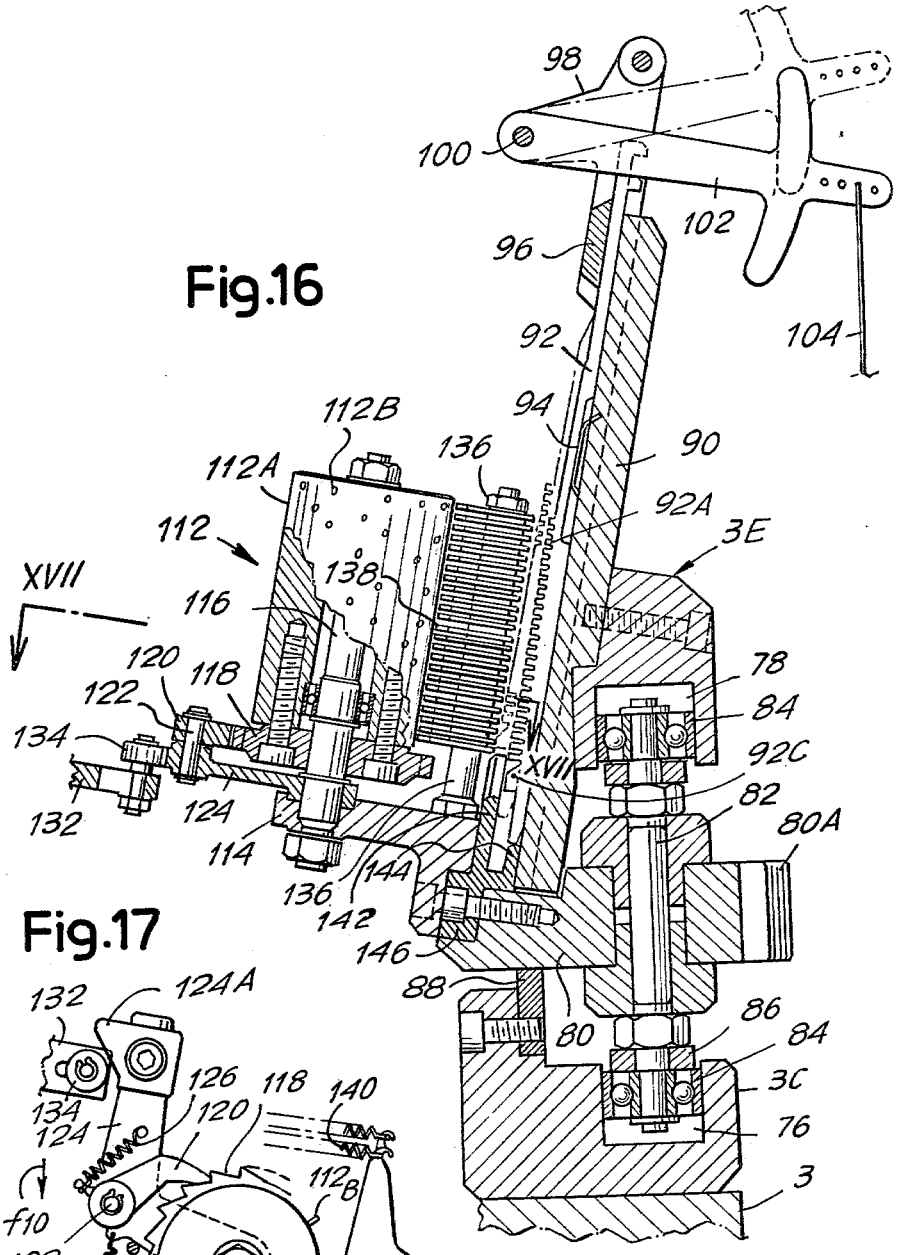
FIG. 16 shows an enlarged detail of the area indicated by arrow XVI of FIG. 3.
Figure 17:
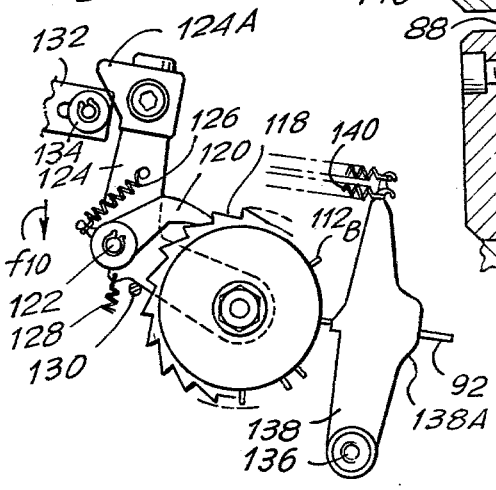
FIG. 17 is a section taken on line XVII—XVII of FIG. 16.
Figure 18:
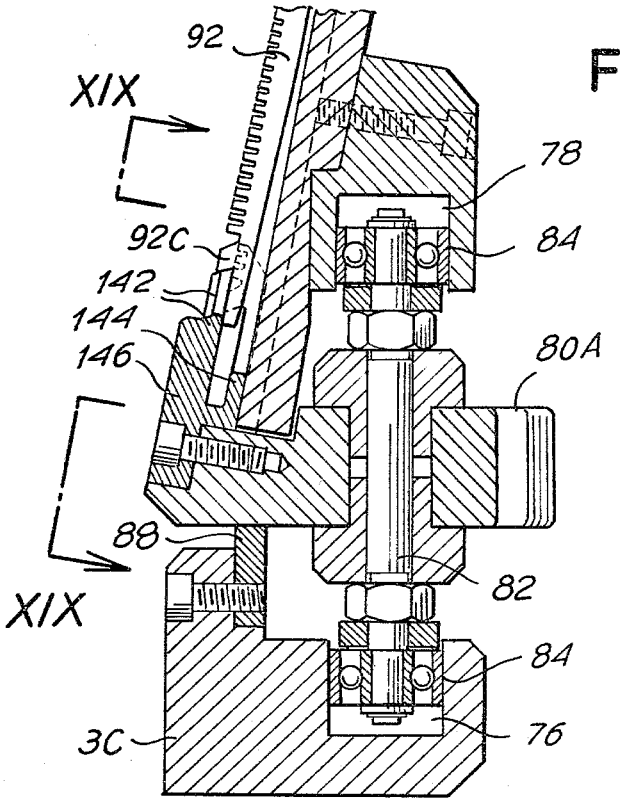
FIG. 18 shows a detail of FIG. 16 in a reversed view.
Figure 19:
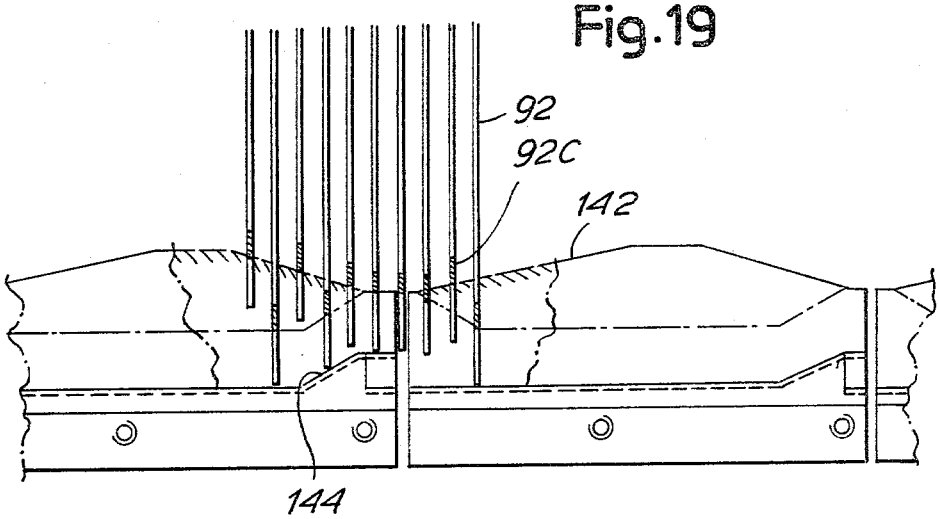
FIG. 19 is a view along line XIX—XIX of FIG. 18.

A bed 90 is mounted on the element 3E and extends along the rectilinear working section for the fabric. The bed 90 has vertical channels in which selector jacks 92 are slidable. The jacks, in the embodiment shown are of the press-selector type and rock in their own plane within the respective channels and are biased by respective springs 94 which act in a sense to urge the lower ends of the selectors 92 outwardly of the bed 90, the upper ends of the selectors being retained by the projection by means of a covering bar 96. Supports 98 are provided above the bed 90 to which levers 102 can pivot as shown in FIG. 16, from a lower position (shown in solid lines) to a raised position (shown in broken lines). Each lever 102 is associated with a different one of the selectors 92, and on each lever 102 there is hooked a tie-rod 104 for one or several heald loops 106, each having an eyelet through which a respective warp extends. Each heald loop 106 is urged downwardly by a tension spring 108, or by a weight, which imposes a downward force both on the levers 102 and the selectors 92. The selectors 92 each have a row of removable butts 92A arranged to co-operate with pattern drum members to be described. To summarize, for each warp there is provided a respective heald loop and each heald loop is associated with a lever 102 and a selector 92; the latter, when raised by the pattern drum members, in turn raises the lever 102 and thereby the associated heald loop (or loops) 106.

The chain formed by the elements 80, 82, 84, 86 is driven continuously by similar means to that provided for driving the first chain. In particular, each block 80 has, on its surface which lies inwardly of the chain path, teeth 80A, and the teeth of adjacent blocks 80 form an arcuate rack along semi-circular connecting portions of the chain track formed in the structure 3. Two gears 110 are provided on an extension of the shafts 56 above the gears 52 and 54 similar to the gears 52 and 54, for driving the second chain.

Each of the blocks 80 of the second chain corresponds to one of the carriage members 22 of the first chain and thus to means for causing a thrust wave for advancing a shuttle 32, and each block 80 carries a pattern drum unit, generally indicated by 112. More particularly, a bracket 114 carrying a shaft 116 is mounted on each block 80 a pattern drum 112A of the unit 112, the drum 112A being provided with pins 112B appropriately distributed to obtain a desired warp selection. A ratchet-toothed rim 118 is rigid with the drum 112A and on this rim there acts an oscillating pawl 120 provided with a reciprocating motion which is linked (see particularly FIG. 17) at 122 to a control lever 124. The lever 125 can rock around the base of the shaft 116 and is provided with a nose 124A at its end. Springs 126 and 128 respectively urge the pawl 120 in a clockwise direction with respect to the lever 124, and the lever 124 in a counterclockwise direction towards a stop 130. A bracket portion 132 is mounted on the stationary structure 3 by means of supports (not shown) and which is provided with seats for locating stops 134, for instance, in the form of stationary rollers, which are intended to act on the noses 124A. Each time a nose 124A, after advance of the chain according to the arrows $f_{10}$ (see FIG. 17) meets a stop 134, the nose imposes a movement in a clockwise direction to the lever 124 and the latter advances the pawl 120 which, in turn, angularly displaces the drum 112A through one step. After passing the stop 134, the lever 124 is returned to rest against the stop 130 and the pawl 120 moves back on the toothed rim 118.

The bracket 114 also carries a second shaft 136 in a position between the bed 90 and the drum 112A. Levers 138 are pivoted on the shaft 136, the levers 138 being separate from one another and being urged by respective springs 140 in a direction toward the surface of the drum 112A. The levers 138 can be moved by the pins 112B in the opposite direction to the action of the springs 140, and are designed to act with a profile 138A on the butts present in the rows of butts 92A of the selectors. In this way, in the presence of a pin 112B and of a butt 92A, the lever 138 is capable of rocking the selector 92 into the interior of the channel in the bed 90 against the action of the spring 94. Thus a selection is possible therefore by means of the single drums 112A which advance with the respective blocks 80 of the second chain. Furthermore, it is thus possible to obtain a selection of the heald loops in a similar manner to that provided by rocking selectors used in knitting machines. For this purpose, each selector 92 has, at its lower end, a butt 92C which is urged outwardly by the spring 94 into engagement with a cam profile 142 when the selector 92 is temporarily raised by a toothed profile 144, carried by, or formed by, a member 146 engaged between the block 80 and the bracket 114. Those selectors 92 having butts 92C which project from the bed 90 and engage the cam profile 142 which raises these selectors against the action of the springs. As a result the respective levers 102 and of the respective heald loops 106 use; those selectors which, on the contrary, are pressed into the interior of the respective grooves in the bed by the profiles 138A of the levers 138 (as a function of the pattern set by the drums 112A), after passing the toothed profile 144, do not engage the profile 142, and consequently are returned downwardly by the bias of the springs 108 or by the action of weights provided instead of the springs 108.

Thus a desired warp pattern is provided by a selection of the heald loops in synchronism with the advancement of the individual shuttles. As the control of the heald loops with this arrangement is combined with means for advancing the shuttle so that one may also provide for the formation of a pattern in combination with particular weft yarns which are selectively loaded on the respective shuttles.

When the pattern permits it, it is also possible to act with stationary levers 138 instead of those selected with the pattern drums. In this case, the drums are inactive or can even be omitted.

Although the machine particularly described has only a single weaving front, the machine can be modified to have two weaving fronts and thus two selection systems for the heald loops 10, two systems for inserting the wefts, and two control units combined with two beds 90, the whole assembly being arranged on two rectilinear parallel sections of the first and second chains. In this case, appropriate feed systems for the warps will be provided in the space between the two active lengths of the structure 3 and winding beams for the two fabrics simultaneously formed, while there will be provided means for twice feeding the wefts from the individual shuttles during one cycle of each shuttle and of each of the chains; individual shuttles and chains operate on both weaving fronts.

The machine particularly described is of relatively simple construction, and provides an efficient weft-carrier thrust, capable of beating-up the weft as soon as it is deposited.

What I claim is:

1. In an improved weaving apparatus of the non-reciprocating continuous type employing, heald loops for controlling warps; weft-carriers slidable in an annular track each to deposit a weft; a series of weft-carrier thrust elements, said thrust elements being successively movable to form a thrust wave for advancing each weft-carrier across the warps, and weft-tank bobbins on said weft-carriers; shaft means forming a support for laminar elements defining seats for said thrust elements; said laminar elements including ring means and lower stationary blade means supporting said shaft means and defining a lower supporting surface of said weft-carriers; said ring means and said lower blade means being cooperating with each other to define annular seats for said thrust elements along said shaft means; said improvement comprising: having said thrust elements as arcuate sinkers with an arcuate development not greater than 180° to be slidably movable in said annular seats and capable of being radially removed from said seats; each of said arcuate sinkers having corresponding control butt and an end projection with a first radial edge active on the weft-carriers, and with a second about a radial opposite edge active on weft being distributed, to beat-up the weft against fabric being formed; stationary lateral blades forming a weft-carrier guide surface; means for rocking said sinkers to urge each sinker through an advancing stroke toward said stationary lateral blades for advancing said weft-carriers with said first active edge, until said projection is let to pass under said weft, and through a return stroke, to beat-up the weft against the fabric; said means for urging said sinkers being defined by control track means engageable with said sinker control butts, and being mounted on an endless chain means; control elements defined by partial-cylindrical surfaces facing said annular seats and having said control track means extending along said partial-cylindrical surfaces; said control elements being carried removably and adjustably toward and from said annular seats on means formed of said chain; said chains being provided with guide and thrust rollers; and stationary tracks mounted on said apparatus for cooperating with said guide and thrust rollers.

* * * * *